US008492630B1

(12) United States Patent
Wonnacott

(10) Patent No.: US 8,492,630 B1
(45) Date of Patent: Jul. 23, 2013

(54) MUSICAL INSTRUMENT PICK WITH REPLACEABLE STRAP

(76) Inventor: David A. Wonnacott, Nashville, TN (US)

( * ) Notice: Subject to any disclaimer, the term of this patent is extended or adjusted under 35 U.S.C. 154(b) by 155 days.

(21) Appl. No.: 13/110,495

(22) Filed: May 18, 2011

(51) Int. Cl.
*G10D 13/00* (2006.01)

(52) U.S. Cl.
USPC ..... 84/320

(58) Field of Classification Search
USPC ..... 84/320–322
See application file for complete search history.

(56) References Cited

U.S. PATENT DOCUMENTS

| | | | |
|---|---|---|---|
| 408,052 | A | 7/1889 | Stoll |
| 557,293 | A | 3/1896 | Wahl |
| 756,348 | A | 4/1904 | Forney |
| 2,045,571 | A | 5/1934 | Dopyera |
| 2,063,011 | A | 11/1935 | Bell |
| 2,776,592 | A | 8/1953 | Di Preta |
| 3,441,169 | A | 4/1969 | Bowers |
| 3,648,558 | A | 3/1972 | Chenette |
| 3,699,838 | A | 10/1972 | Montgomery |
| 3,789,720 | A | 2/1974 | McIntyre |
| 4,020,732 | A | 5/1977 | Kelly |
| 4,102,234 | A | 7/1978 | Brundage |
| 4,122,746 | A | 10/1978 | Freeman |
| 4,270,433 | A | 6/1981 | Adamec |
| 4,625,616 | A | 12/1986 | McVicker |
| D291,809 | S | 9/1987 | Jasper |
| 4,867,032 | A | 9/1989 | Lukehart |
| 5,837,913 | A | 11/1998 | Newman |
| 6,335,477 | B1 | 1/2002 | Miller |
| 6,797,871 | B2 | 9/2004 | Atkin |
| 6,949,700 | B1 | 9/2005 | Kelly |
| 7,157,635 | B2 | 1/2007 | Sogabe |
| 7,435,889 | B1 | 10/2008 | Heidt |
| 2002/0178891 | A1 * | 12/2002 | Atkin ..... 84/322 |
| 2009/0229442 | A1 * | 9/2009 | Hollin, Jr. ..... 84/322 |

* cited by examiner

*Primary Examiner* — Kimberly Lockett
(74) *Attorney, Agent, or Firm* — Bruce E. Weir

(57) ABSTRACT

A musical instrument pick has a flat pick with parallel slots through which an adjustable strap is passed. The strap has a wide portion and a narrow portion. The narrow portion is passed through the slots until a shoulder of the wide portion encounters a slot and prevents further passage of the strap. The strap has hook-and-loop surfaces that allow a user to adjust the strap to a wide range of digit diameters and shapes.

5 Claims, 2 Drawing Sheets

MUSICAL INSTRUMENT PICK WITH REPLACEABLE STRAP

BACKGROUND

Many guitar players choose to use guitar picks to protect their fingers and/or because of the different sounds guitar strings produce when played with a pick instead of with bare fingers. The most widely-used pick design is thin, flat, roughly triangular in outline, and is usually grasped between a player's thumb and forefinger. A player must grasp a pick firmly to hold the pick in position, causing fatigue during extended playing sessions. Perspiration can make a pick slippery, forcing a player to grip a pick even more firmly and thus become fatigued more quickly.

The need to grasp a pick may be avoided by use of a pick that attaches to a player's thumb. A "thumb pick" usually has a rigid or semi-rigid loop that is sized to fit players whose thumb diameters fall within a certain range. The loop is often tapered and contoured so that the loop will slide partially onto a player's thumb, then jam firmly into position. A pick is either riveted onto or molded as part of the loop. Once a pick is too worn to be used the entire assembly must be discarded.

While sizing and contouring may secure a pick on a player's thumb it also limits placement of the pick to a specific position with respect to the end of the player's thumb, thereby limiting the player's range of techniques. Since player's hands vary in size and shape, a loop that is sufficiently rigid to remain securely in place is likely to fit poorly on many players' thumbs.

SUMMARY

A musical instrument pick has a flat pick with a pair of parallel slots having substantially the same length. A narrow portion of a strap is slightly narrower than the length of the slots. A wide portion of the strap is substantially wider than the length of the slots. The strap is passed through the slots until the wide portion pulls up against a surface of the pick, preventing further passage. The wide portion wraps around an instrument player's thumb or finger and the narrow portion wraps around the wide portion, then fixed in place by a hook and loop fastener.

The strap allows easy adjustment to fit any digit. Since the strap is not permanently attached to the pick, either element can be easily replaced if worn or broken. The strap and slot configuration prevents the pick from rotating with respect to the strap. The musical instrument pick can be worn towards the base of the thumb or towards the tip. All of these features and advantages of embodiments of the invention, and more, are illustrated below in the drawings and detailed description that follow.

DETAILED DESCRIPTION

In the Summary of the Invention above and in the Detailed Description of the Invention, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components.

Where reference is made herein to a method comprising two or more defined steps, the defined steps can be carried out in any order or simultaneously (except where the con-text excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number) (a second number)," this means a range whose lower limit is the first number and whose upper limit is the second number. For example, 25 to 100 mm means a range whose lower limit is 25 mm, and whose upper limit is 100 mm.

Figure 1:
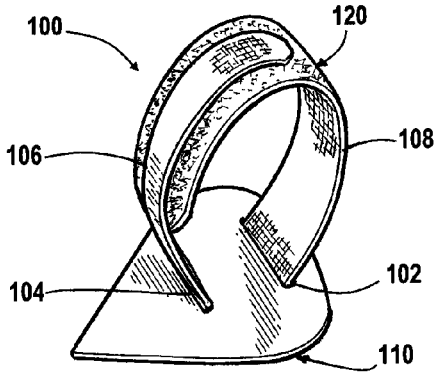
FIG. 1 is a perspective view of an embodiment of a musical instrument pick with adjustable hook-and-loop straps.

A musical instrument pick with a replaceable, adjustable strap allows any player to comfortably attach the pick to his or her thumb and to easily replace a worn pick or strap. FIG. 1 shows a perspective view of an embodiment of such a musical instrument pick 100 with a replaceable, adjustable strap 120 attached to a flat pick 110.

Figure 2:
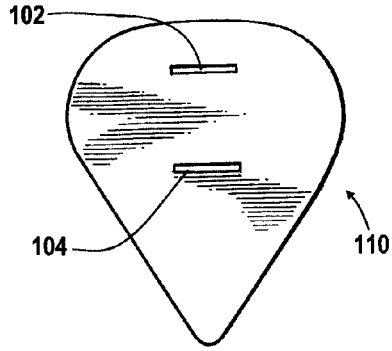
FIG. 2 is a top plan view of a replaceable pick.

A narrow strap portion 106 passes through a first pick slot 102 in a flat pick 110, back through a second pick slot 104, and wraps around a wide strap portion 108. FIG. 2 shows a top plan view of a flat pick 110, which can be made of plastics such as DELRIN® or celluloid, or wood, metal, ceramics, or other materials known in the art. The assignment of first pick slot and second pick slot is arbitrary and the narrow strap portion may be passed first through any slot from either side of the pick. Alternate embodiments may include additional pick slots.

Although the embodiment of FIG. 2 shows a commonly-preferred pick shape, any pick shape can be adapted to the present invention. The first 102 and second 104 pick slots are sufficiently separated so that once a strap is installed and the assembly is attached to a thumb, the pick 110 cannot easily rotate within its plane and become disoriented in the way that riveted thumb picks often do. At the same time, the pick is attached in a region close to its centroid and the edges of the pick 110 are unencumbered, allowing manipulation of the orientation of the pick 110 by the player.

Figure 3:
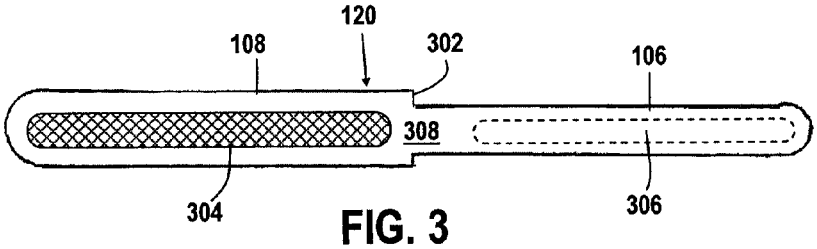
FIG. 3 is a top plan view of a replaceable hook-and-loop strap.

FIG. 3 shows a top plan view of a replaceable hook-and-loop strap 120 with a narrow strap portion 106 and a wide strap portion 108. The width of the narrow strap portion 106 shown in FIG. 3 is exaggerated with respect to the typical width of the wide strap portion 108. A shoulder 302 marks the transition point between the narrow strap portion 106 and the wide strap portion 108. The strap 120 may be cut from a single piece of webbing, fabric, or other flat, flexible material known in the art, or the narrow strap portion 106 and the wide strap portion 108 may be made from separate pieces of such material joined together.

The width of narrow strap portion 106 is slightly less than the width of the first 102 and second 104 pick slots. The wide strap portion 108 is substantially wider than the width of the first 102 and second 104 pick slots, so that a strap 120 may pass through the first 102 and second 104 pick slots only until the shoulder 302 pulls up against a surface of the pick 100.

A strip of loop material 304 is attached to the lower surface 308 of the strap 120. A strip of hook material 306 is attached to the upper surface 310 of the strap 120. While the strips of hook and loop material shown in FIG. 3 are of nearly equally width and cover only central portions of the strap 120, in other embodiments the loop material may cover much or all of a surface of the strap 120 and the hook material may cover much or all of the opposite surface of the strap 120. A typical embodiment comprises a wide strap portion 108 that is much wider than the narrow strap portion 106, with loop material covering a surface of the wide strap portion 108.

When the strap 120 is wrapped around onto itself, the hook material 306 engages the loop material 304, temporarily locking the strap 120 into a fixed loop. Alternatively, the hook material 306 may be disposed on the lower surface 308 and the loop material 304 disposed on the upper surface 310. Although any hook-and-loop material suitable for attachment to fabric will suffice, a low profile hook-and-loop material similar to 3M™ DUAL LOCK™ Low Profile Reclosable Fastener SJ4570 creates a less bulky and more flexible strap assembly.

Figure 4A:
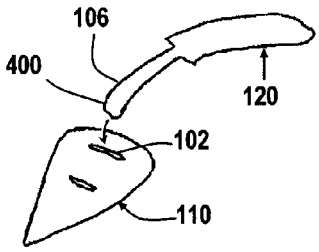
FIG. 4A is a perspective view of a hook-and-loop strap being inserted into an upper pick slot.
Figure 4B:
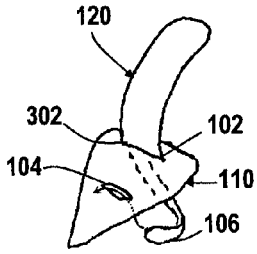
FIG. 4B is a perspective view of a hook-and-loop strap passing through a lower pick slot.
Figure 4C:
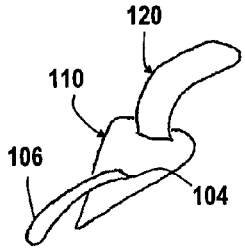
FIG. 4C is a perspective view of an assembled pick and hook-and-loop strap.
Figure 5:
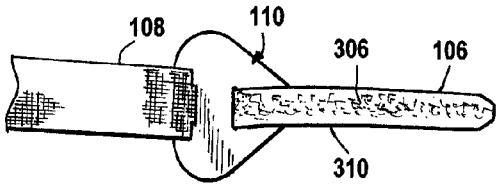
FIG. 5 is a top plan view of an assembled pick and strap.
Figure 6:
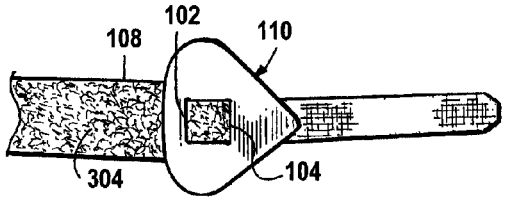
FIG. 6 is a bottom plan view of the assembled pick and strap of FIG. 5.

FIG. 4A shows an initial step in the installation of a pick 110 on a strap 120. The narrow end 400 of the narrow strap portion 106 is inserted through the first pick slot 102. As shown in FIG. 4B, the narrow strap portion 106 is pulled through the first pick slot 102 until the shoulder 302 pulls up against a surface of the pick 110. The narrow strap portion 106 is then inserted through the second pick slot 104 and pulled through until taut. FIG. 5 shows a top plan view of an assembled pick and strap. FIG. 6 shows a bottom plan view of the assembled pick and strap of FIG. 5. Assembly can be initiated from either side of the pick 110 and through either pick slot.

Once the pick 110 and strap 120 are assembled the musical instrument pick 100 can be attached to a player's thumb or finger by separating the narrow strap portion 106 and the wide strap portion 108, placing the musical instrument pick 100 in a desired position along the length of a digit, wrapping the wide strap portion 108 around the digit, then wrapping the narrow strap portion 106 around the wide strap portion 108 so that the hook material 306 engages the loop material 304. Friction between the secured strap 120 and the player's digit fixes the musical instrument pick 100 in place until the strap 120 portions are again separated.

Figure 7:
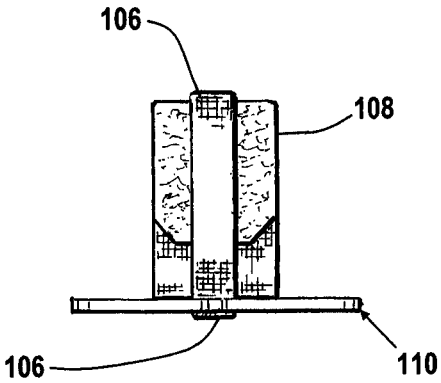
FIG. 7 is a front elevation view of an assembled pick and strap.
Figure 8:
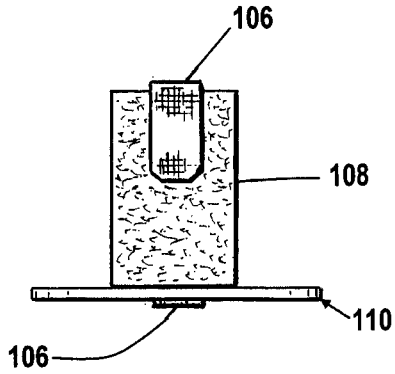
FIG. 8 is a rear elevation view of the assembled pick and strap of FIG. 7.
Figure 9:
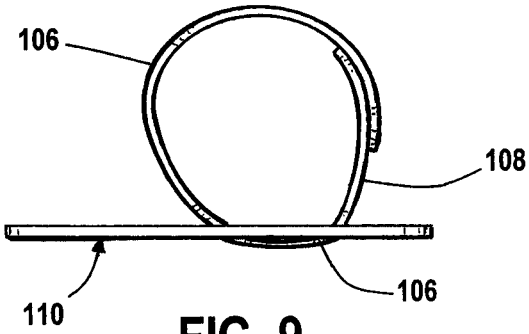
FIG. 9 is a side elevation view of the assembled pick and strap of FIG. 7.
Figure 10:
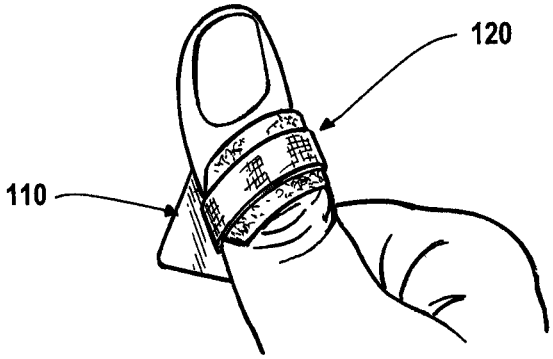
FIG. 10 shows the assembled pick and adjustable strap of FIG. 7 attached to a player's thumb.

FIG. 7 shows a front elevation view of a musical instrument pick. FIG. 8 shows a rear elevation view of the musical instrument pick of FIG. 7. FIG. 9 shows a side elevation view of the musical instrument pick of FIG. 7. FIG. 10 shows the musical instrument pick of FIG. 7 attached to a player's thumb.

Embodiments of this invention offer several advantages over existing instrument picks. The adjustable strap 120 provides "one size fits all" convenience. Since the strap 120 is not permanently attached to the pick 110, either element can be easily replaced if worn or broken. Passing the strap 120 through parallel slots 102, 104 in the pick 110 creates a musical instrument pick 100 that is more stable than many known pick designs by preventing the pick 110 from rotating with respect to the strap 120.

Embodiments of the invention can be worn towards the base of the thumb or towards the tip. This is helpful because different players grip their picks in different ways. Earlier "molded" thumb picks restricted pick placement to a more or less fixed part of the thumb. In an embodiment where the wide strap portion is much wider than the narrow strap portion and the wide strap portion is covered with hook or loop material, the narrow strap portion may be wrapped at an angle across a surface of the wide strap portion, causing the closed loop of the fastened strap to assume a cone shape that may adjusted to conform to different portions of a player's digit. The ability of embodiments of the invention to adjust easily to different parts of a digit allows a player to choose between using the flesh of the thumb tip to strike the bass strings, as is preferred by classical guitarists, or to use the plastic portion of the pick to strike the bass strings, which is more common in blues, country and folk playing.

A player may optionally use embodiments of the invention as a flat pick only. The strap 120 decreases the likelihood that a pick will be dropped during a performance where excessive perspiration can make a player's grip uncertain. The force necessary to hold the pick is greatly reduced. The use of slots and removable straps allows for different pick thicknesses, sizes and styles to be used with the same strap, making the straps both reusable and interchangeable.

The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

I claim:

1. A musical instrument pick, comprising:

a pick, the pick having a first surface, a second surface, and at least a first pick slot and a second pick slot, the pick slots passing between the first and second surfaces;

a strap, the strap having a narrow strap portion, a wide strap portion, a shoulder disposed between the narrow strap portion and the wide strap portion, an upper surface, and a lower surface, the width of the narrow strap portion being less than the width of the first and second pick slots, the wide strap portion being wider than the width of the first and second pick slots, the narrow strap portion passing through the first pick slot until the shoulder contacts the first surface, the narrow strap portion additionally passing through the second pick slot from the second surface to the first surface; and a hook-and-loop fastener having a first strip and a second strip, the first strip being disposed upon the upper surface, the second strip being disposed upon the lower surface.

2. A musical instrument pick as claimed in claim 1, wherein the first and second pick slots are of equal length and disposed near the centroid of the first surface.

3. A musical instrument pick as claimed in claim 1, wherein the hook-and-loop fastener comprises a low-profile reclosable fastener.

4. A method for using a musical instrument pick with an attached strap having a wide strap portion and a narrow strap portion, comprising:

placing the musical instrument pick in a desired position along the length of a player's digit;

wrapping the wide strap portion around the player's digit;

orienting the narrow strap portion at an angle with respect to the wide strap portion; and wrapping the narrow strap portion around the wide strap portion so that hook material disposed on the narrow strap portion engages loop material disposed on the wide strap portion and the strap forms a conical closed loop.

5. A method for using a musical instrument pick with an attached strap having a wide strap portion and a narrow strap portion, comprising:

placing the musical instrument pick in a desired position along the length of a player's digit;

wrapping the wide strap portion around the player's digit;

orienting the narrow strap portion at an angle with respect to the wide strap portion; and wrapping the narrow strap portion around the wide strap portion so that loop material disposed on the narrow strap portion engages hook material disposed on the wide strap portion and the strap forms a conical closed loop.

* * * * *